United States Patent [19]

Villavicencio

[11] Patent Number: 4,699,691

[45] **Date of Patent: * Oct. 13, 1987**

[54] THERMOMECHANICAL DIGESTION PROCESS

[75] Inventor: Eduardo J. Villavicencio, San Angel, Mexico

[73] Assignee: W. R. Grace & Co., New York, N.Y.

[ * ] Notice: The portion of the term of this patent subsequent to Aug. 25, 2004 has been disclaimed.

[21] Appl. No.: 772,574

[22] Filed: Sep. 4, 1985

Related U.S. Application Data

[60] Continuation-in-part of Ser. No. 486,678, Apr. 20, 1983, abandoned, and a continuation-in-part of Ser. No. 495,659, May 18, 1983, abandoned, each is a continuation-in-part of Ser. No. 412,060, Aug. 27, 1982, abandoned, which is a division of Ser. No. 210,057, Nov. 24, 1980, Pat. No. 4,347,101.

[51] Int. Cl.[4] ..... D21C 3/26

[52] U.S. Cl. ..... 162/19; 162/22; 162/23; 162/94; 162/96

[58] Field of Search ..... 162/25, 26, 21, 22, 162/19, 90, 241, 246, 17, 18, 24, 28, 52, 96, 94

[56] References Cited

U.S. PATENT DOCUMENTS

| | | | |
|---|---|---|---|
| 1,938,802 | 12/1933 | Braun et al. | 162/19 |
| 2,996,421 | 8/1961 | Green . | |
| 3,238,088 | 3/1966 | Villavicencio et al. | 162/19 |
| 3,313,677 | 4/1967 | Carr | 162/19 |
| 3,354,030 | 11/1967 | Williams et al. | 162/22 |
| 3,388,037 | 6/1968 | Asplund et al. | 162/26 |
| 3,397,110 | 8/1968 | Rosenblad | 162/52 |
| 3,446,699 | 5/1969 | Asplund et al. | 162/26 |
| 3,773,610 | 11/1973 | Shouvlin et al. | 162/19 |
| 4,295,925 | 10/1981 | Bentvelzen et al. | 162/22 |
| 4,347,101 | 8/1982 | Villavicencio | 162/25 |
| 4,363,697 | 12/1982 | Markham et al. | 162/19 |

FOREIGN PATENT DOCUMENTS 0043206 5/1982 Peru .

*Primary Examiner*—Steve Alvo

*Attorney, Agent, or Firm*—William W. McDowell, Jr.; Michael J. McGreal

[57] ABSTRACT

A process for thermomechanical digestion using a multiple blowdown technique. The digestion chemical is added just prior to blowdown which results in a concentration of digesting chemicals on the fiber. The process can be carried out with a digester having multiple chambers, each at a lower pressure has many advantages in forming pulps suitable for newsprint or fine papers from wood and vegetable fiber sources. The digester should be of a kind where the fiber will have a greater residence time in subsequent chambers.

10 Claims, 1 Drawing Figure

THERMOMECHANICAL DIGESTION PROCESS

Figure 1:
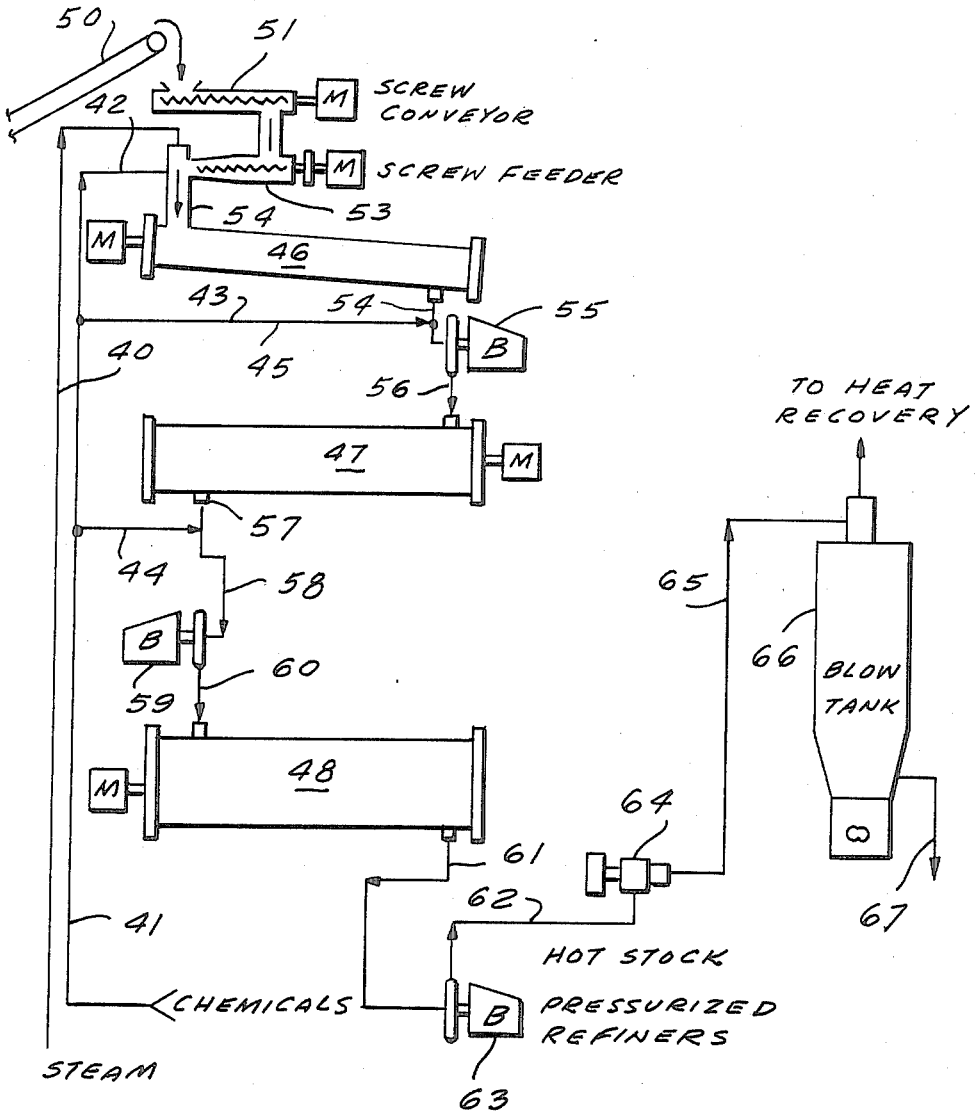

This application is a continuation-in-part of U.S. Ser. No. 495,659, filed May 18, 1983, now abandoned; and also of U.S. Ser. No. 486,678, filed Apr. 20, 1983, now abandoned; each of which is, in turn, a continuation-in-part of U.S. Ser. No. 412,060, filed Aug. 27, 1982, now abandoned; which is again, in turn, a division of U.S. Ser. No. 210,057, filed Nov. 24, 1980, now U.S. Pat. No. 4,347,101.

This invention primarily relates to improved processes and digesters for producing a high quality pulp, and more particularly to improved thermochemical fiber pulping process for producing such pulps. The improved digester consist of two or more separate tubular chambers, and provides for the addition of chemicals just prior to the rapid pressure reduction between tubular chambers.

Most of the newsprint in the world is produced from wood fibers. This includes the use of softwoods and hardwoods. The reason is that wood-derived fibers are longer and as a result can produce a stronger newsprint. Also, since the initial wood fiber is longer than vegetable-derived fibers, such as bagasse, straw, reed, bamboo, or the like, these can undergo a fairly vigorous pulping and bleaching to produce a suitable newsprint. Bagasse and bamboo are typical non-wood fiber sources which are most used for paper making, but these fiber sources cannot be pulped and bleached in the same manner as wood fibers and yield as good a product. If so treated, the relatively shorter fibers will produce a lower strength paper product. This results in a poor newsprint product and one which tears during printing.

The present digesters can also be used with wood fiber sources. However, these digesters are particularly useful for non-wood fiber sources.

The present discoveries are directed primarily to techniques and digesters for processing non-wood fibers such as bagasse and bamboo, to produce a variety of useful paper products. When used to produce newsprint, the thermochemical pulp is usually intermixed with a thermo-chemical pulp. The thermomechanical pulp produces a paper with greater strength while the thermochemical pulp has a greater brightness. The net result upon mixing the pulps is a pulp which can produce a paper sufficient in strength and brightners to make a suitable newsprint. However, although the processes and equipment disclosed in this application will be discussed with regard to bagasse and bamboo, it is to be understood that they can be applied to hardwood or softwood-derived fibers.

When bagasse or bamboo are to be used to make a pulp the pulping process comprises starting with a well depithed and washed fiber source. Preferably, this has been prepared using either of the techniques set forth in U.S. Pat. No. 4,231,136 or U.S. Pat. No. 4,237,582 at the paper mill. The result of these techniques is a fiber which is substantially free of pith, dirt and soluble materials, which in part makes subsequent processing by mlder treatment techniques feasible.

This depithed and washed fiber is then in a condition to be thermochemically processed to a pulp. Regardless of the mode of pulping, at least a two chamber digester with means for rapid depressurization and chemical addition between the chambers is used. The digester is of a type where the residence time of the fiber is greater in the second chamber. Also, the digester provides for the addition of chemicals just prior to a rapid pressure reduction. The reason for requiring multiple chambers is that a rapid pressure reduction between each chamber will provide for better penetration of the added chemicals resulting in better pulping. The reason for preferring to have a greater residence time in the second chamber is that the fiber has undergone a rapid pressure reduction where the conversion of water in the fiber to steam has blown the fiber bundles apart. Thus, in the second chamber, the fibers are more open with the result of more chemical penetration along with an automatic increase in chemical concentration. The chemicals concentration on the fibers increases due to the loss of water of dilution as steam during the rapid depressurization between chambers. After digestion, the fibers undergo other preparation steps such as hot refining, washing, and screen cleaning operations. A thermochemical pump will usually undergo a bleaching after washing and screening.

It is an important part of this digestion process that digestion chemicals, in addition to being added along with the fiber to the first chamber, be added subsequently just prior to a between chamber rapid depressurization. That is, the sequence is to digest the fibers in a first chamber with chemicals, add additional digestion chemicals, rapidly reduce the pressure at least 0.5 $kg/cm^2$, and to digest the fibers in a second digestion chamber. This sequence can be repeated until atmospheric pressure is reached. However, usually no more than three stages of digestion are used.

Using this sequence, the digestion chemicals which are added before a rapid depressurization can be added in a more dilute form and in a greater volume. This allows for a better wetting of the fibers. The following rapid depressurization then raises the concentration of the chemicals so that in the subsequent digestion chamber the chemicals are at a more effective concentration. They are also at a more effective concentration on new fiber surfaces exposed as a result of the rapid depressurization.

This digestion process and the associated equipment will now be discussed in more detail with reference to the following drawings:

The FIGURE is a two-dimensional diagram of a thermochemical digestger having three stages of digestion, each stage having a greater volume than the prior stage, and with chemical addition and rapid depressurization between each stage.

The FIGURE illustrates in a thermochemical mode the use of up to three stages of digestion where, along with the residence time of the pulp in a stage of digestion increases with each stage of digestion, there is an addition of digestion chemicals followed by a rapid depressurization between each stage of digestion. In more detail a feed fiber source such as bagasse, bamboo, euclytus or wood fragments is fed from conveyor 50 into the screw conveyor 51. Preferably the feed fiber has a water content of about 50 to 60 weight percent. The screw conveyor and screw feeder 53 meter the fiber into input 54 of tubular digester 46. The screw feeder also functions as a valve mechanism to maintain the elevated pressure in tubular chamber 46. The screw conveyor and screw feeder each have a screw driven by a motor M. Each tubular chamber also has a conveyor screw driven by a motor M. The screw conveyor in each tubular chamber moves the fiber from one end to the other. The speed of the screw will determine the residence time of the fiber in a tubular chamber. Each tubular chamber has an internal diameter of about 0.2 to 4 meters, and a length of about 2 meters to 20 meters. Each tubular chamber need not have the same dimensions. A change in tubular chamber size will change the residence time of the fiber within a chamber and, in fact, is a convenient way to change residence time in a chamber. Each tubular chamber is constructed of steel and has a wall thickness sufficient to withstand up to about 30 kg/sq.cm. of internal pressure.

Steam is injected into tubular chamber 46 at input conduit 54. This steam is injected with the feed fiber. The steam is at a pressure of about 2 to 20 kg/sq cm and preferably about 5 to 15 kg/sq cm. This steam serves to further wet the fiber and to heat the fiber to a temperature of about 130° C. to 200° C. The exact temperature will be dependent on the pressure of the steam. Steam at a given pressure will have a corresponding temperature. While traversing tubular chamber 46, the fibers are heated to the steam temperature. The digestion chemicals are added wtih the feed fiber and prior to each digestion stage. When added prior to a digestion stage, the digestion chamber chemicals are added prior to the rapid pressure reduction. In the FIGURE the digestion chemicals are added through lines 41, 42 43 and 44. Up to a two-thirds by volume of the digestion chemicals can be added through line 42 to the feed fiber. Up to two-thirds of the remaining digestion chemicals are added through line 43 with the remaining digestion chemicals added through line 44. Line 43 adds digestion chemicals to the partially digested fiber from tubular chamber 46. This is added just prior to the first pressure reduction. Line 44 adds any remaining digestion chemicals to the partially digested fibers from tubular chamber 47 prior to a second rapid pressure reduction.

A screw in tubular chamber 46 moves the fibers through the digester, and simultaneously mildly works the fibers and aids in impregnating the chemicals into the fibers. The fibers exit the tubular chamber 46 at line 54 and undergo a rapid pressure reduction at 55 of at least 0.5 kg/sq.cm., and preferably at least 1 kg/sq.cm. The rapid pressure reduction can be accomplished by a conventional blowdown valve or through use of a disc refiner. This is designated as B in the FIGURE. A disc refiner can function as the pressure reduction means and simultaneously work the fiber to further open and separate the fiber bundles. The pressure reduction, itself, also separates the fibers through the rapid conversion of fiber-contained water to steam. This steam contained in the fiber bundles explodes the fiber bundles apart thereby segregating the fibers. The fiber now at a reduced pressure enters tubular chamber 47 via conduit 56.

A motor M turns the screw in tubular chamber 47 at a speed to provide a continuous flow of fiber through the chamber. The screw again provides a mild working of the fiber to further separate the further and aids in the impregnation of the chemicals, the concentration of which have been increased by the pressure reduction. Also, since tubular chamber 47 has a larger volume than tubular chamber 46 the screw in tubular chamber 47 will be run at a lower speed to provide a greater residence time in tubular chamber 47. At the exit 57 of tubular chamber 47, the fiber passes through line 58 and undergoes another rapid pressure reduction at 59. The decrease in pressure will again be about 0.5 kg/sq.cm. and preferably about 1 kg/sq.cm. Also, as in the pressure reduction from 46 to 47, the pressure reduction means can be a conventional blowdown valve or a disc refiner.

The fiber, after pressure reduction, enters tubular chamber 48 through line 60. This tubular chamber is shown as having a greater internal volume than tubular chamber 47. Digestion chemicals are added through line 44 and are mixed with the fibers just prior to rapid depressurization. The screw in tubular chamber 48 conveys the fibers to the exit end of the tubular chamber. The fibers exit the tubular chamber 48 at line 61 and undergo refining at 63. The fibers then flow by conduit 62 to pressure reduction at 64. This pressure reduction again reduces the pressure at least 0.5 kg/sq cm and preferably 1 kg/sq cm. This pressure reduction means can also be a conventional blowdown valve or a disc refiner. The fibers then flow through line 65 to blowdown tank 66, where the pressure is reduced to atmospheric pressure. The fibers exit the blow tanks at 67 and are washed and subject to other procesing steps. An example of such processing steps is set out in U.S. Pat. No. 4,347,101.

When the fiber source is wood, the tubular chambers should have a greater volume than for bagasse or bamboo. This is the case since a longer residence time will be required for each stage. Further, the pressure in the first tubular chamber should be higher and the pressure differential between the tubular chambers greater. This is necessary to get a better opening and digestion of the fiber.

When sodium hydroxide is used for digestion, an 8 to 12 percent by weight solution is used. This has a Ph of about 12 to 14. The preferred sulfite cook liquor consists of a molar ratio of sodium sulfite to sodium hydroxide of about 3 to 1. This results in a liquor having a Ph of about 10.8 to 11. A typical kraft liquor which can be used consists of sodium sulfite and sodium hydroxide in a molar ratio of about 2 to 1. Up to two-thirds of the digestion chemicals are added with the feed fiber with up to two-thirds of the remaining cooking liquor is added just prior to the pressure reduction between the first and second tubular chambers with the remainder added just prior to the rapid pressure reduction between the second and third tubular chambers. This provides for maintaining an effective amount of cooking liquor on the fiber throughout digestion. Regardless of the digestion chemicals used, the digestion chemical to fiber ratio (bone dry basis) is in the range of 3–10 to 1.

The improved provided by the present process is that the digestion chemicals can be added at a dilute concentration and in a greater volume. This provides for easier and more uniform wetting of the fibers. During each rapid depressurization, the concentration of the chemicals on the fibers (bone dry basis) can be increased 1 to 4 percent by weight depending on the degree of the pressure drop. This increased chemicals concentration is present on the new fiber surfaces which have been exposed in the prior rapid depressurization. The concentration increase (water loss) can be readily calculated from tables which give the heat of vaporization of water at different temperatures and pressures.

Using this improvement of when to add digestion chemicals various modifications can be made to the disclosed digestion processes. However, these would be within the scope of the present invention since any such modification would be using the benefits of this invention.

I claim:

1. An improvement in the process for thermomechanically digesting cellulosic fiber sources, said process comprising:

(a) conveying a cellulose fiber source into a first chamber of a digester and contacting the cellulose fiber source wtih steam and a first quantity of digestion chemicals at a steam pressure of 2 kg/sq.cm. to 15 kg/sq.cm. for a first period of time;

(b) removing said cellulose fiber source from said first chamber, and rapidly decreasing the pressure on said cellulose fiber source at least 0.5 kg/sq.cm. to a first lower pressure wherein water within said cellulose fiber source flashes to steam opening the fibers; and (c) inputing said cellulose fiber source at said first lower pressure into a second chamber of said digester for contacting said cellulose fiber source wtih said digestion chemicals at said first lower pressure for a second period of time;

said improvement comprising adding a second quantity of digestion chemicals to said cellulose fiber source after removing said fiber source from said first chamber and just prior to rapidly reducing the pressure on said fiber source to a first lower pressure wherein water of dilution from said second quantity of digestion chemicals converts to steam thereby concentrating said digestion chemicals on said fibers.

2. An improvement in the process for thermomechemically digesting cellulosic fiber sources as in claim 1 wherein after contacting said cellulose fiber source at said first lower pressure a third quantity of digestion chemicals is added to said cellulose fiber source and the pressure on said cellulose fiber source is rapidly decreased at least 0.5 kg/sq.cm. whereby water within said celluose fiber source flashes to steam thereby concentrating said third quantity of digestion chemicals on said fibers, and said cellulosic fiber source is contacted with said digestion chemicals for a third period of time.

3. An improvement in the process for thermochemically digesting cellulosic fiber sources as in claim 2 wherein said digestion chemicals contain sodium hydroxide in a concentration of 8 to 12 percent by weight.

4. An improvement in the process for thermochemically digesting cellulosic fiber sources as in claim 3 wherein the concentration of the digestion chemicals on said cellulosic fiber source increases 1 to 4 percent by weight when the pressure is reduced at least 0.5 kg/sq.cm.

5. An improvement in the process for thermochemically digesting cellulosic fiber sources as in claim 1 wherein the concentration of the digestion chemicals on said cellulosic fiber source increases 1 to 4 percent by weight when the pressure is reduced at least 0.5 kg/sq.cm.

6. An improvement in the process for thermochemically digesting cellulosic fiber sources as in claim 5 wherein up to two-thirds of the digestion chemicals by volume are added to the cellulose fiber source as the first quantity of digestion chemicals.

7. An improvement in the process for thermochemically digesting cellulosic fiber sources as in claim 2 wherein the concentration of the digestion chemicals on said cellulosic fiber source increases 1 to 4 percent by weight when the pressure is reduced at least about 0.5 kg/sq.cm.

8. An improvement in the process for thermochemically digesting cellulosic fiber sources as in claim 7 wherein up to two-thirds of the digestion chemicals by volume are added to the cellulose fiber source as the first quantity of digestion chemicals and up to two-thirds of the remaining digestion chemicals by volume are added to cellulose fiber source as the second quantity of digestion chemicals.

9. An improvement in the process for thermochemically digesting cellulosic fiber sources as in claim 1 wherein said cellulosic fiber source is selected from the group consisting of bagasse and bamboo.

10. An improvement in the process for thermochemically digesting cellulosic fiber sources as in claim 2 wherein said cellulosic fiber source is selected from the group consisting of bagasse and bamboo.

* * * * *

UNITED STATES PATENT AND TRADEMARK OFFICE

CERTIFICATE OF CORRECTION

PATENT NO. : 4,699,691

DATED : Oct. 13, 1987

INVENTOR(S) : Eduardo J. Villavicencio

It is certified that error appears in the above-identified patent and that said Letters Patent is hereby corrected as shown below:

In the Heading, at block [73] Assignee:

Delete "W. R. Grace & Co., New York, N.Y."
and substitute:

--Process Evaluation and Development Corp., Dallas, Tex.--.

Signed and Sealed this

Seventh Day of June, 1988

*Attest:*

DONALD J. QUIGG

*Attesting Officer*

*Commissioner of Patents and Trademarks*